US006808440B2

(12) United States Patent
Mundt

(10) Patent No.: US 6,808,440 B2
(45) Date of Patent: Oct. 26, 2004

(54) METHOD OF GRINDING CUTTING BLADES

(75) Inventor: Eric G. Mundt, Rochester, NY (US)

(73) Assignee: The Gleason Works, Rochester, NY (US)

( * ) Notice: Subject to any disclaimer, the term of this patent is extended or adjusted under 35 U.S.C. 154(b) by 0 days.

(21) Appl. No.: 10/354,682

(22) Filed: Jan. 30, 2003

(65) Prior Publication Data

US 2003/0148717 A1 Aug. 7, 2003

Related U.S. Application Data

(60) Provisional application No. 60/355,591, filed on Feb. 7, 2002.

(51) Int. Cl.[7] ..... B24B 3/34
(52) U.S. Cl. ..... 451/48; 451/57
(58) Field of Search ..... 451/48, 10, 14, 451/45, 57, 541, 461

(56) References Cited

U.S. PATENT DOCUMENTS

| | | | |
|---|---|---|---|
| 3,881,889 | A | 5/1975 | Hunkeler |
| 4,144,678 | A | 3/1979 | Ellwanger et al. |
| 4,183,182 | A | 1/1980 | Kotthaus |
| 4,488,381 | A | 12/1984 | Konersmann |
| 4,575,285 | A | 3/1986 | Blakesley |
| 5,168,661 | A | 12/1992 | Pedersen et al. |
| 5,241,794 | A | 9/1993 | Pedersen et al. |
| 5,480,343 | A | 1/1996 | Pedersen et al. |
| 6,004,078 | A | 12/1999 | Clark et al. |
| 6,120,217 | A | 9/2000 | Stadtfeld et al. |

FOREIGN PATENT DOCUMENTS

| | | |
|---|---|---|
| DE | 19827897 | 12/1999 |
| EP | 0322079 | 6/1989 |

OTHER PUBLICATIONS

Gleason Works brochure "300 CG CNC Cutter Blade Sharpener", Jul. 1998.

*Primary Examiner*—Robert A. Rose
(74) *Attorney, Agent, or Firm*—Robert L. McDowell

(57) ABSTRACT

A method of grinding cutting blades with a grinding wheel having first and second grinding edges. The method comprises rough grinding at least one surface of the cutting blade with the first grinding edge and finish grinding at least one surface of the cutting blade with the second grinding edge.

14 Claims, 9 Drawing Sheets

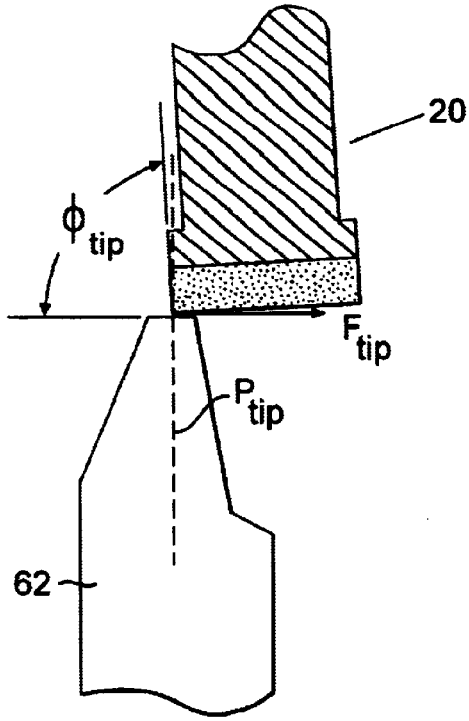
FIG. 7(a)
FIG. 7(b)
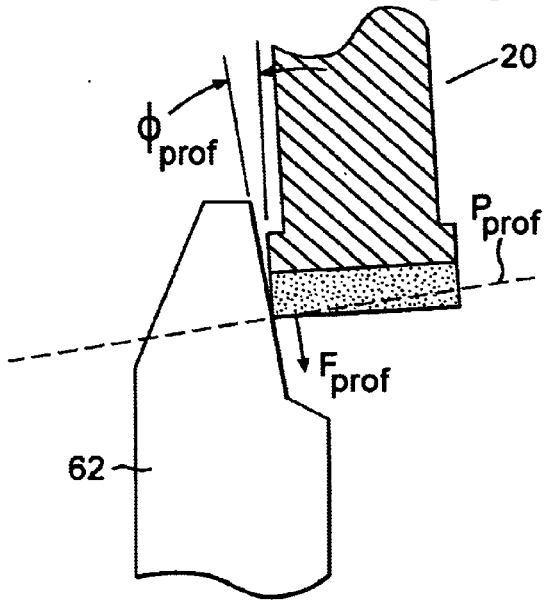
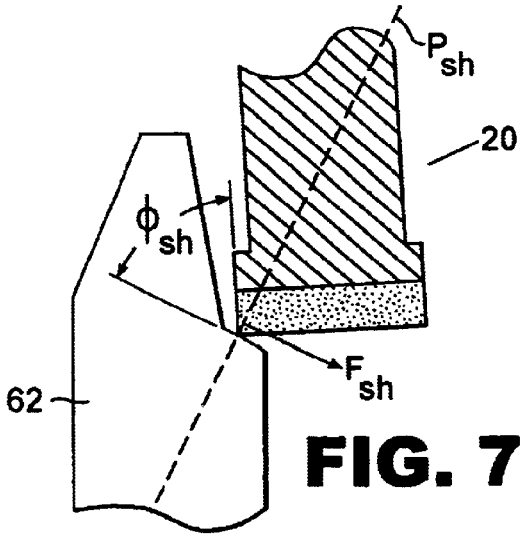
FIG. 7(c)

METHOD OF GRINDING CUTTING BLADES

This application claims the benefit of U.S. Provisional Application No. 60/355,591 filed Feb. 7, 2002.

FIELD OF THE INVENTION

The present invention is directed to cutting tools for producing gears and other toothed articles. In particular, the present invention relates to a method of grinding cutting tools.

BACKGROUND OF THE INVENTION

Grinding of cutting blade blanks or cutting blades is usually performed when initially producing desired surfaces and/or edges on a cutting blade blank to form a cutting blade, or, when a worn cutting blade is ground (sharpened) to restore surfaces and/or edges to their original condition.

In the manufacture of gears and other toothed articles, especially bevel and hypoid gears, it is common to employ cutting blades known as "stick-type" cutting blades usually formed from a length of bar stock material, for example, high speed steel (HSS) or carbide.

Predominantly, there are two styles of stick-type cutting blades. There are those cutting blades that when sharpened require only two side profile surfaces (pressure angle side and clearance side) to be ground in order to restore the respective cutting and clearance edges of the blades. Examples of such blades can be seen in U.S. Pat. No. 4,575,285 to Blakesley, U.S. Pat. No. 6,004,078 to Clark et al. or U.S. Pat. No. 6,120,217 to Stadtfeld et al.

The other style commonly found are those cutting blades that in addition to grinding the two side profile surfaces also requires grinding of the front face of the cutting blade in order to restore cutting and clearance edges. An example of these cutting blades can be found in U.S. Pat. No. 4,183,182 to Kotthaus.

In grinding either of the above types of cutting blades there are generally two methods employed, form grinding and generating grinding. In form grinding, a grinding wheel has a desired blade geometry dressed into the wheel. Plunging the grinding wheel against the cutting blade imparts the dressed form onto the cutting blade. Examples of this type of grinding can be seen in U.S. Pat. No. 4,144,678 to Ellwanger et al., U.S. Pat. No. 3,881,889 to Hunkeler or previously mentioned U.S. Pat. No. 4,183,182. With processes such as those above, a large area of contact exists which may result in significant heat build-up leading to burning of the tool and/or rapid degradation of the grinding wheel especially if aggressive grinding practices are followed (i.e. rapid rate of stock removal or a large amount of stock material removed per pass of the grinding wheel).

In generating grinding, a grinding wheel having a simple profile form is utilized to grind cutting blades. Relative motion between the grinding profile surface and the cutting tool result in the desired geometry being generated on the cutting tool. Examples of generating processes carried out by cup-shaped grinding wheels having a roughing section and a simple profile form section for finish grinding can be found in U.S. Pat. No. 5,168,661 to Pedersen et al. or U.S. Pat. No. 5,480,343 to Pedersen et al. In these types of processes, the finish profile form also represents a significant total area of contact with the cutting blade thus again presenting not only the risk of burning of the cutting blade and degradation of the grinding wheel but also exhibiting significant wear. Since the simple profile form is utilized for finishing operations, aggressive grinding practices may be damaging to the grinding wheel and/or cutting blade and frequent dressing of the finish profile form is required to restore the worn surface in order to maintain an acceptable profile form.

U.S. Pat. No. 4,488,381 to Konersmann teaches a method of grinding cutting blades utilizing a grinding disk that is traversed along a surface of a grinding wheel and which employs the circular edge of the grinding disk to remove material from the cutting blade. Only one grinding edge of the grinding disk is utilized for grinding and when the grinding disk becomes worn, the grinding disk is moved laterally to bring the grinding disk closer to a cutting tool such that sufficient abrasive action may again take place.

SUMMARY OF THE INVENTION

The present invention comprises a method of grinding cutting blades with a grinding wheel having first and second grinding edges. The method comprises rough grinding at least one surface of the cutting blade with the first grinding edge and finish grinding at least one surface of the cutting blade with the second grinding edge.

The present invention also includes a method of forming primary and secondary relief surfaces on the cutting profile surface of a cutting blade. The primary relief surface extends from the cutting edge to a location inward of the cutting edge and is oriented according to the nominal cutting relief angle specified for that particular side of the cutting blade. The secondary relief surface extends from the inward edge of the primary relief surface to the back face of the blade. The secondary relief surface is oriented with a relief angle equal to or greater than the nominal relief angle required for that side of the cutting blade.

BRIEF DESCRIPTION OF THE DRAWINGS

FIGS. 7(*a*), 7(*b*) and 7(*c*) illustrate the grinding wheel inclination angle $\phi_{tip}$, $\phi_{prof}$, and $\phi_{sh}$, respectively, for tip, profile, and shoulder relief surfaces on a typical cutting blade.

DETAILED DESCRIPTION OF THE PREFERRED EMBODIMENT

In the present invention it is to be understood that the term "grinding cutting blades" is intended to include those grinding processes wherein a cutting blade blank is initially ground to produce desired surfaces (e.g. pressure angle, clearance angle, top relief angle, rake angle, etc.) and edge conditions (e.g. cutting edge, clearance edge, etc.) thereon as well as those instances where existing cutting blade surfaces are ground to restore the desired surface geometry and edge conditions (i.e. sharpening).

Figure 1:
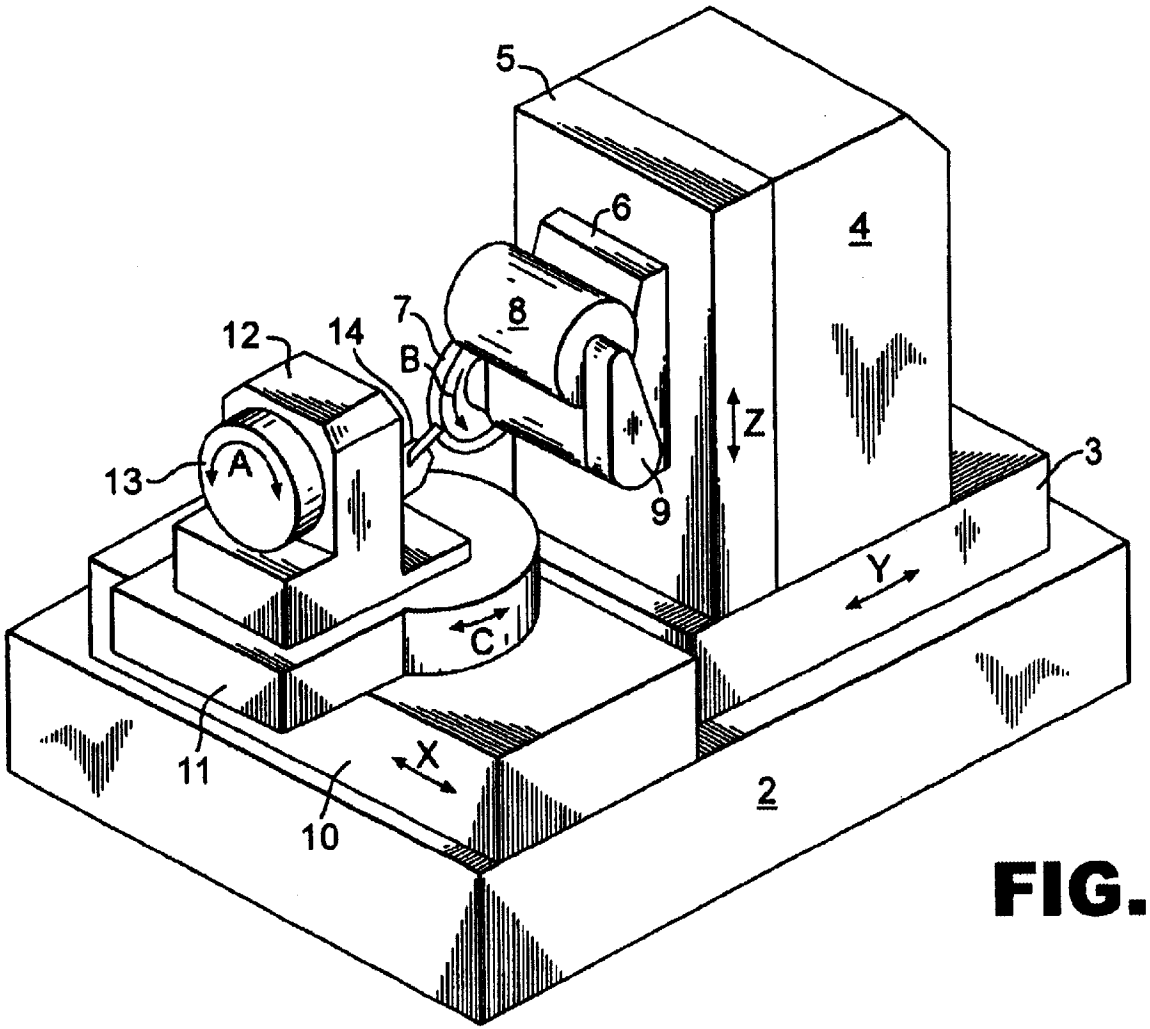
FIG. 1 is a schematic representation of a machine for carrying out the present inventive process.

A preferred sharpening or grinding machine for carrying out the present invention is schematically shown in FIG. 1. The machine is of the contour grinding type and is one having computer numerical control (CNC) and is described below. Machines of this type are well known in the art and are commercially available, such as, for example, the 300CG CNC Cutter Blade Sharpening machine manufactured by The Gleason Works, Rochester, N.Y.

The machine comprises a base 2 upon which a tool carriage 3 is mounted via slides or ways (not shown). The tool carriage 3 is movable on the slides along the machine base 2 in a direction Y (Y-axis). Located on tool carriage 3 is a tool column 4 to which is mounted tool slide 5, via ways or slides (not shown), for movement in a direction Z (Z-axis) perpendicular to the Y-axis movement of tool carriage 3. A tool head 6 is secured to tool slide 5 and an appropriate stock removing tool, such as a grinding wheel 7, is mounted for rotation to the tool head 6. The grinding wheel 7 is rotatable about an axis B and is driven by a motor 8 acting through suitable reduction gearing 9.

Also mounted via slides or ways (not shown) to machine base 2 is a first workpiece carriage 10 which is movable along the machine base 2 in a direction X (X-axis) perpendicular to both the Y-axis and Z-axis movements. A second workpiece carriage 11 is pivotally mounted to the first workpiece carriage 10 and is pivotable about an axis C. Secured to the second workpiece carriage 11 is workpiece column 12 in which a spindle (not shown) is journaled for rotation about axis A and is driven by motor 13. A blade holder 14 is releasably mounted to the spindle for rotation about the A-axis.

Relative movement of the tool 7 and blade holder 14 along each of the mutually perpendicular axes X, Y, and Z is imparted by respective drive motors (not shown) which act through speed reducing gearing and recirculating ball screw drives (not shown). Pivoting of the second workpiece carriage 11 about the C-axis is imparted by a drive motor (not shown) acting through a worm which engages with a worm wheel carried by the pivotable workpiece carriage 11. The above-named components are capable of independent movement with respect to one another or may move simultaneously with one another.

Each of the respective drive motors, except the tool drive motor 8, is associated with either a linear or rotary encoder as part of a CNC system which governs the operation of the drive motors in accordance with input instructions input to a computer. The encoders provide feedback information to the computer concerning the actual positions of each of the movable machine axes. CNC systems for controlling the movement of multiple machine axes along prescribed paths are commonplace. Such state-of-the-art systems are incorporated in the machine to control relative movements of the grinding wheel and cutting blade along or about selected axes to describe desired paths for grinding (e.g. sharpening) stick-type cutting blades in accordance with the present inventive process.

Figure 2:
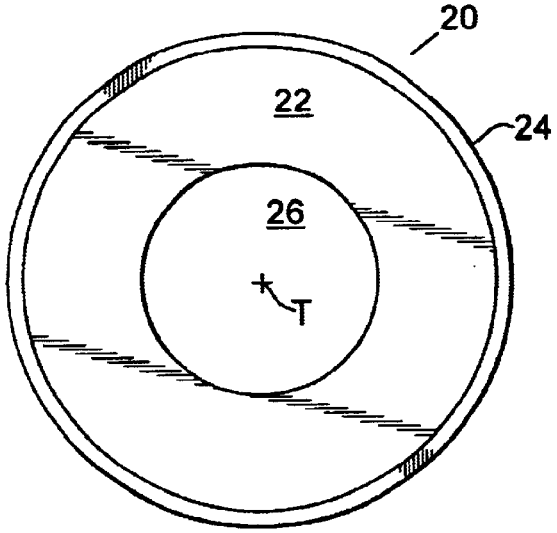
FIG. 2 is a side view of a preferred grinding wheel for implementing the inventive process.
Figure 3:
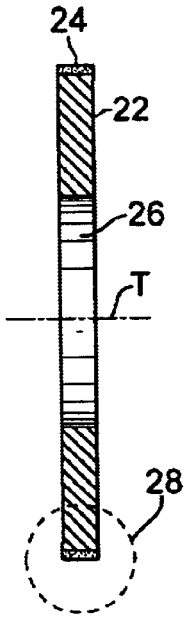
FIG. 3 is a cross sectional view of the grinding wheel of FIG. 2.
Figure 4:
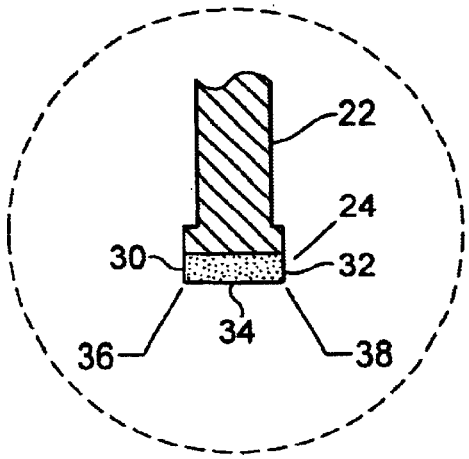
FIG. 4 is an enlarged view of a radially outward portion of FIG. 3.
Figure 5A:
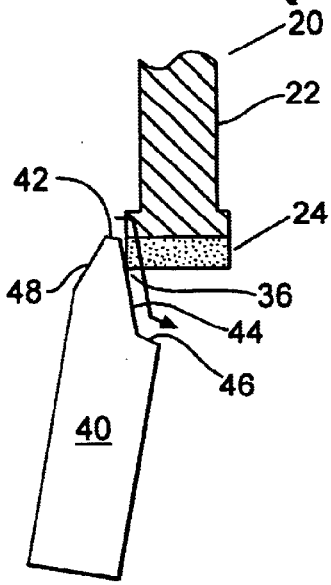
FIGS. 5(*a*), 5(*b*), 5(*c*) and 5(*d*) illustrate a grinding sequence for a cutting blade requiring only grinding of its side surfaces for sharpening.
Figure 5B:
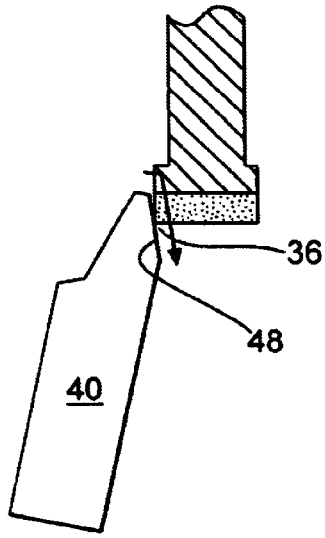
Figure 5C:
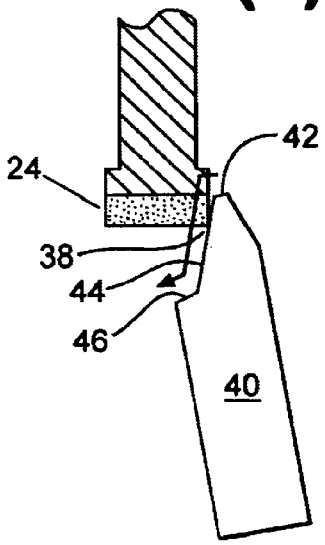
Figure 5D:
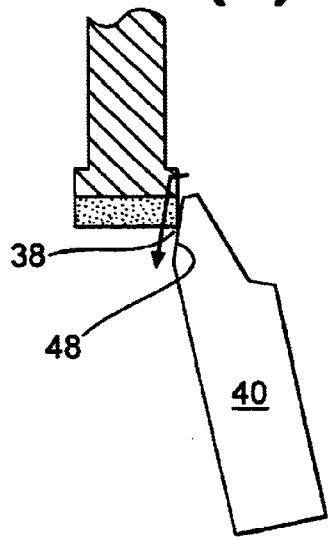
Figure 6A:
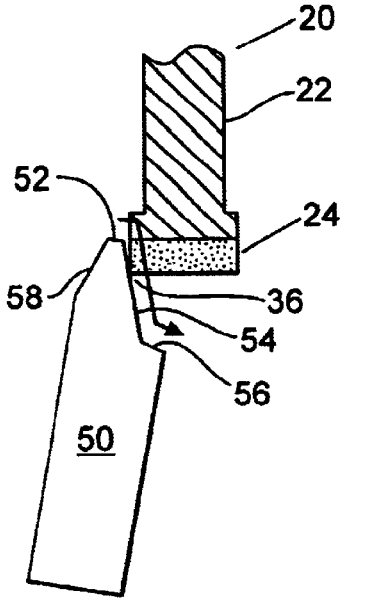
FIGS. 6(*a*), 6(*b*), 6(*c*), 6(*d*) and 6(*e*) illustrate a grinding sequence for a cutting blade requiring grinding of its side surfaces and front face for sharpening.
Figure 6B:
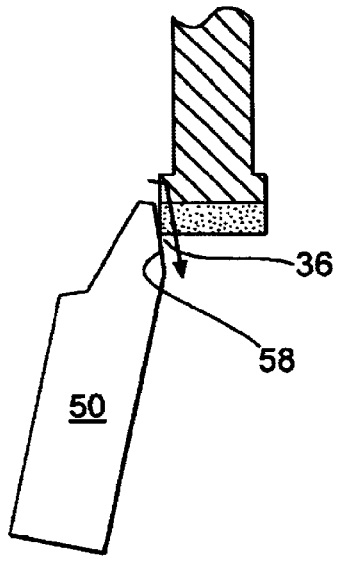
Figure 6C:
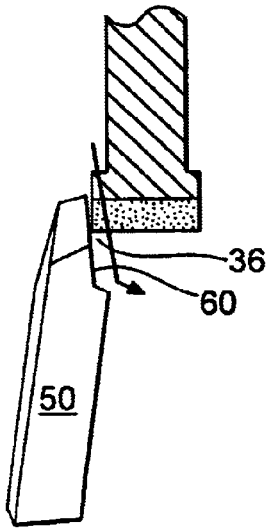
Figure 6D:
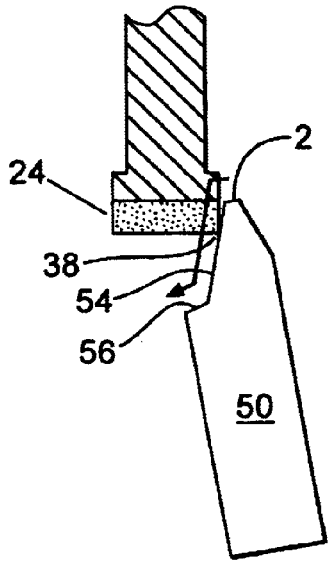
Figure 6E:
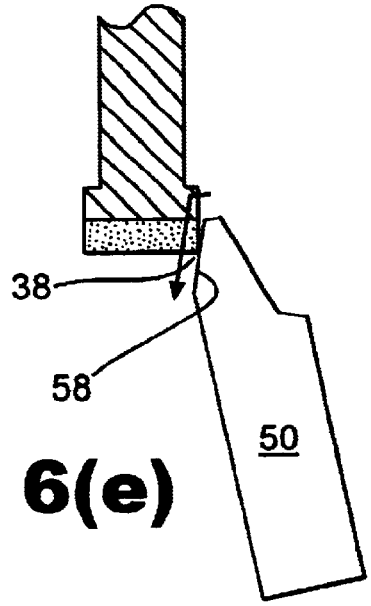

An example of a preferred grinding wheel for carrying out the inventive process is shown in FIGS. 2–4. In FIG. 2, the grinding wheel 20 is shown in side view and comprises an axis of rotation, T, a body portion 22 made of, for example, steel or aluminum, and a peripheral abrasive grinding portion 24 comprising abrasives made of, for example, resin-bond diamond or cubic boron nitride (CBN). Grinding wheel 20 further includes a central opening 26 for positioning the grinding wheel 20 on a tool spindle of a grinding machine such as the machine shown in FIG. 1. FIG. 3 is a cross sectional view of grinding wheel 20 showing a cross-sectional plane containing the axis T. A radially outward section of grinding wheel 20 is circled as shown by 28 and this portion of grinding wheel 20 is illustrated in enlarged form in FIG. 4.

In FIG. 4, abrasive grinding portion 24 is shown to include a first side 30, a second side 32 and an outermost surface 34. The intersection of first side 30 with outermost surface 34 defines a first grinding edge 36 and the intersection of second side 32 with the outermost surface 34 defines a second grinding edge 38.

It has been discovered that by dedicating one of the grinding edges (e.g. 36) for rough grinding operations and the other grinding edge (e.g. 38) for finish grinding operations, less frequent dressing operations (i.e. reconditioning of the grinding wheel to its original form) need to be conducted. This is due to removing the bulk of material during rough grinding with the same grinding edge while preserving the other grinding edge for finish grinding. Rough grinding with the same edge can be carried out for longer periods of time since there is no need to finish grind with the same grinding edge. Even though the rough grinding edge may begin to show signs of wear, it is still acceptable to continue use of the grinding edge for rough grinding since rough grinding does not necessitate maintaining an exact grinding form on the grinding wheel as would be required of finish grinding were performed with the same grinding edge.

On the other hand, restricting finish grinding to one grinding edge results in that particular grinding edge consistently removing a small amount of stock material since there is no rough grinding conducted by this edge. Hence, there is little wear on the finish grinding edge and thus, longer periods of time can elapse between needed dressing operations. In fact, more than one dressing operation may be conducted on the rough grinding edge before it is necessary to dress the finish grinding edge.

With the present inventive process, the amount of time required to grind a cutting blade is reduced. This is due to a small contact area between the grinding wheel and a cutting blade. Since only the edge of the grinding wheel is utilized, a small area of contact is established. With such a small contact area, heat buildup is reduced thus enabling faster relative movement of the grinding wheel with respect to the cutting blade (e.g. faster traversal of the grinding wheel along the cutting blade). Hence, faster grinding cycles can be realized.

Also with the present inventive process, the amount of time required for dressing of the grinding wheel is reduced since for either grinding edge 36, 38, it is only necessary to dress the region of the respective side surface 30, 32 and outermost grinding surface 34 that is adjacent grinding edge 36, 38. Since these regions are small, dressing to restore either grinding edge 36, 38 requires a dressing tool to traverse over small areas thus enabling the dressing cycle to be short in duration.

An example of a grinding cycle is illustrated in FIGS. 5(*a*)–5(*d*) wherein a cutting blade 40 that requires only grinding of the side surfaces for sharpening is illustrated. In FIG. 5(*a*), rough grinding edge 36 is traversed across top surface 42, along the cutting profile surface 44 (i.e. pressure angle side) and across the shoulder 46 of cutting blade 40. In FIG. 5(*b*) cutting blade 40 is then repositioned and clearance profile surface 48 (i.e. clearance angle side) is rough ground. Cutting blade 40 is again repositioned as shown in FIG. 5(*c*) and finish grinding edge 38 is traversed along top surface 42, cutting profile surface 44 and shoulder 46. Finally, as seen in FIG. 5(*d*), cutting blade 40 is positioned so that finish grinding edge 38 passes along clearance profile surface 48.

FIGS. 6(*a*)–6(*e*) illustrate another example wherein a cutting blade 50 that requires grinding of the side surfaces and the front surface for sharpening is illustrated. In FIG. 6(*a*), rough grinding edge 36 is traversed across top surface 52, along cutting profile surface 54 (i.e. pressure angle side) and across the shoulder 56 of cutting blade 50. In FIG. 6(*b*) cutting blade 50 is then repositioned and clearance profile surface 58 (i.e. clearance angle side) is rough ground. Cutting blade 50 is repositioned as seen in FIG. 6(*c*) so that front face 60 is ground by rough grinding edge 36. Cutting blade 50 is again repositioned as shown in FIG. 6(*d*) and finish grinding edge 38 is traversed along top surface 52, cutting profile surface 54 and shoulder 56. Finally, as seen in FIG. 6(*e*), cutting blade 50 is positioned so that finish grinding edge 38 passes along clearance profile surface 58.

A grinding wheel with an essentially cylindrical shape (FIGS. 2,3 or 4) is preferably used in order to take advantage of the reduced time required to grind a cutting blade with the present inventive method. Due to the cylindrical shape of the wheel and the inclination angle of the wheel relative to the feed direction along the blade surface, the relief surface produced on the cutting blade will be concave. In FIGS. 7(*a*), 7(*b*) and 7(*c*), the grinding wheel inclination angle is shown as $\phi_{tip}$, $\phi_{prof}$, and $\phi_{sh}$, respectively, for tip, profile, and shoulder relief surfaces on a typical blade 62. Arrows $F_{tip}$, $F_{prof}$, and $F_{sh}$ indicate the wheel feed direction in each case.

Figure 8:
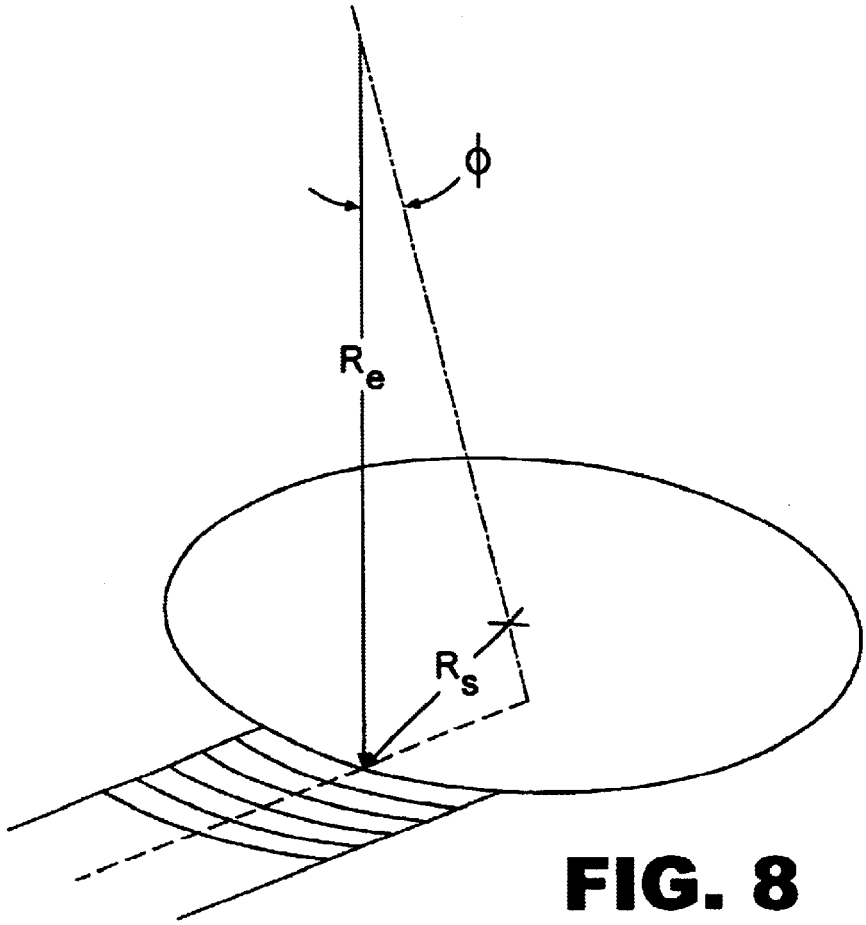
FIG. 8 depicts concave curvature imparted to a cutting blade relief surface in a section normal to that surface.

FIG. 8 generically depicts the concave curvature imparted to the blade relief surface in a section normal to that surface. This curvature is a function of the wheel radius $R_s$ at the wheel edge contacting the blade, and the wheel inclination angle $\phi$. In a plane normal to the relief surface, the equivalent curvature radius $R_e$ is approximately:

$$R_e = R_s / \cos\phi \qquad \text{(Equation 1)}$$

This equation shows that the equivalent radius of curvature of the cutting blade relief surface becomes smaller (i.e. more pronounced) as the wheel inclination angle $\phi$ becomes greater or the wheel radius $R_s$ becomes smaller.

Figure 9A:
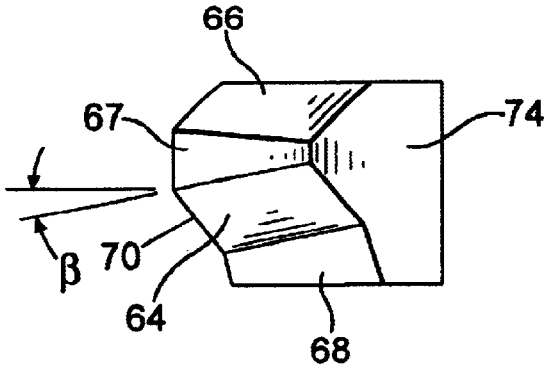
FIGS. 9(*a*) and 9(*b*) illustrate, respectively, the nominal side relief angle $\beta$ for the pressure angle side and the nominal top relief angle $\lambda$ of a typical cutting blade.
Figure 9B:
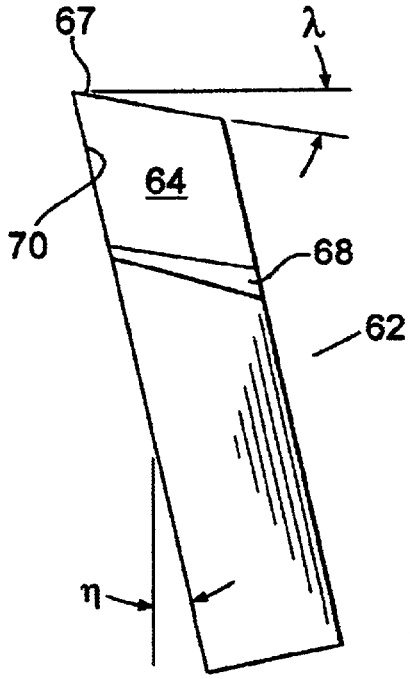

Cutting blades are typically designed with very specific cutting relief angles, normally distinctly assigned to pressure angle side, clearance side, and top surfaces. The nominal side relief angle for the pressure angle side 64 of a typical blade 62 is shown as $\beta$ in FIG. 9(*a*). Although not shown, a similar relief angle exists on the other side (clearance side 66). FIG. 9(*b*) depicts the nominal top relief angle $\lambda$ of top surface 67, normally defined relative to a plane that contains the blade tips in an assembled cutter. The blade tilt angle $\eta$ is defined relative to the axis of the assembled cutter. Both side and top relief angles are required at the cutting edge 70 to produce the desired cutting action and blade wear characteristics dictated by the gear or pinion cutting application.

Figure 10A:
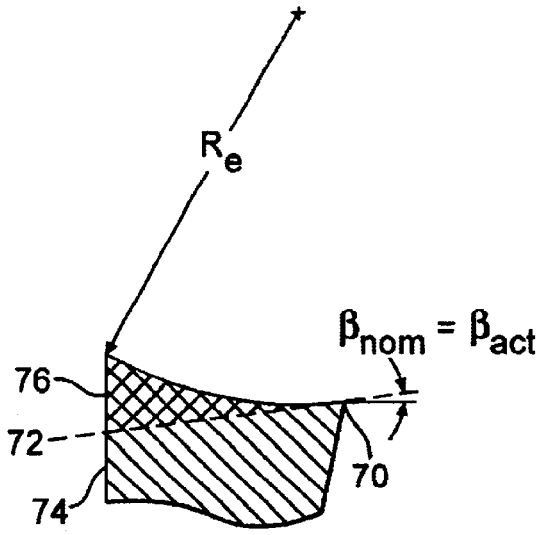
FIGS. 10(*a*) and 10(*b*) show examples of undesirable blade surface curvature that may result when grinding with a cylindrical grinding wheel.
Figure 10B:
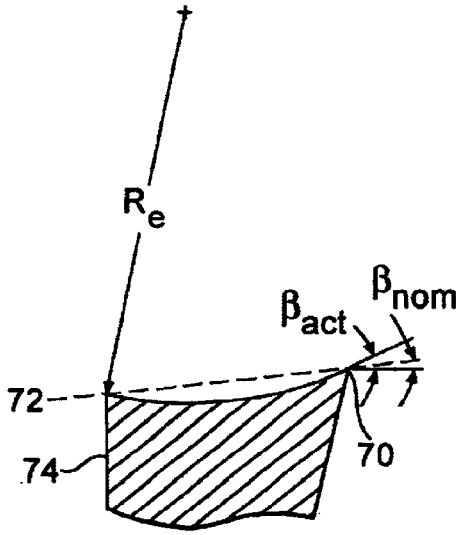

At the same time, cutting relief angles are specified to provide adequate clearance between the blade surface extending to the back of the blade and the gear tooth slot being machined. However, it is only possible to reach a compromise with these requirements if the blade relief surfaces have concave curvature. Namely, if the relief angle requirement is held at the cutting edge of the blade, then a significant portion of the blade material extending to the back of the blade will violate the relief surface clearance requirement. FIG. 10(*a*), which depicts a normal section through the pressure angle relief surface of a blade as per plane $P_{prof}$ in FIG. 7(*b*), shows this situation. The cutting side relief angle requirement $\beta_{act}=\beta_{nom}$ is held at the cutting edge 70, but extending towards back of blade 74 extra material 76 left on the blade may cause interference with the gear slot during cutting.

If, during grinding with the inventive process, the relief angle curvature is shifted so that the clearance requirement is met along the entire relief surface extending to the back of the blade, then the cutting relief angle $\beta$ will be incorrect. FIG. 10(*b*), which depicts a normal section through the pressure angle relief surface of a blade as per plane $P_{prof}$ in FIG. 7(*b*), shows this situation. In this case, the blade material extending from the cutting edge 70 to the back of blade 74 does not extend beyond the relief surface design envelope 72 determined by the nominal relief angle, so the side clearance criteria is met. However, the relief angle $\beta_{act}$ at the cutting edge is not the same as the nominal relief angle $\beta_{nom}$. This may degrade the intended cutting action of the blade.

The geometric compromises shown in FIGS. 10(*a*) and 10(*b*) apply also to other relief surfaces on the blade, such as the tip 67 and shoulder 68 (FIG. 9(*a*)). In the case of the blade tip, for example, the diagrams would be interpreted with respect to the normal section $P_{tip}$ in FIG. 7(*a*), and top angles $\lambda_{nom}$ and $\lambda_{act}$ would replace relief angles $\beta_{nom}$ and $\beta_{act}$. The main difference between relief surfaces is the magnitude of the imparted concave curvature, which is due to the different wheel inclination angles used on these respective surfaces and determined such as by Equation 1. It can thus be appreciated that the relief surface curvature is generally more pronounced on the cutting blade tip and shoulder surfaces, where the wheel inclination angle is relatively large for any process using a cylindrical wheel and feed motions described above. Depending on the cutting application, this may cause a substantial reduction in performance with respect to cutting action or blade side clearance.

It has been discovered that, in cases where the cutting action and/or side clearance would otherwise be compromised by the relief surface curvature, it is advantageous to form primary and secondary relief surfaces on one or more of the cutting profile surfaces. The primary relief surface extends from the cutting edge to a location inward of the cutting edge, while the secondary relief surface extends from the inward edge of the primary surface to the back face of the blade. When used in conjunction with a grinding wheel having first and second grinding edges, the secondary surface is normally created by the roughing edge of the wheel, while the primary surface is normally finished in a separate pass by the finishing edge of the wheel.

Since the orientation of the grinding wheel to the cutting blade can be changed between roughing and finishing passes, the orientation of the curvature imparted on the primary and secondary surfaces can be manipulated to satisfy the clearance requirement along the entire blade relief surface. Also, since the width of the primary land can be made small relative to the total width of the blade from cutting edge to back, the error between the nominal and actual cutting relief angle at the cutting edge can be substantially reduced.

Figure 11:
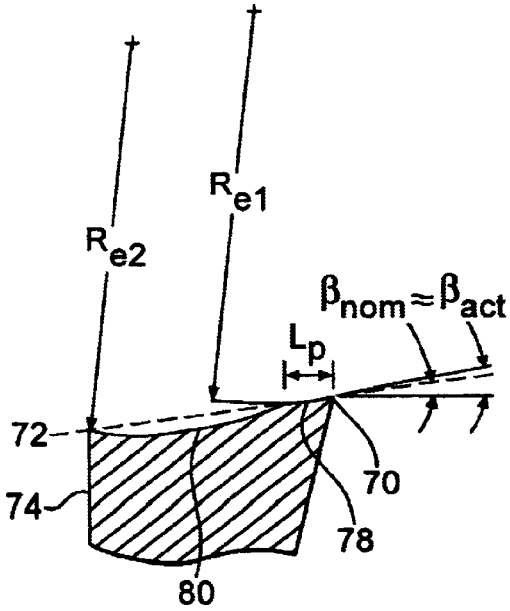
FIG. 11 illustrates a method of grinding that overcomes the undesirable blade surface conditions shown in FIGS. 10(*a*) and 10(*b*).
Figure 12A:
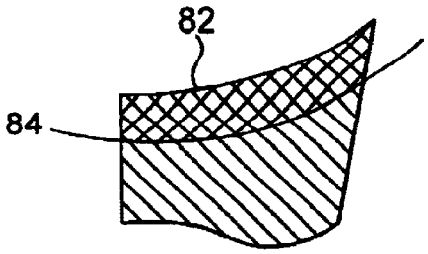
FIGS. 12(*a*), 12(*b*), 12(*c*) and 12(*d*) illustrate the difference in finish stock volume between single relief surface grinding and primary/secondary relief surface grinding.
Figure 12B:
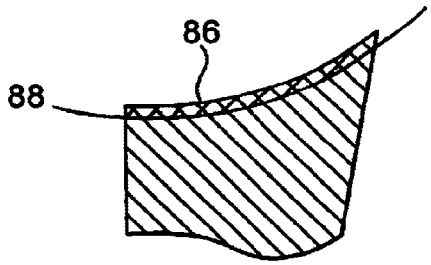
Figure 12C:
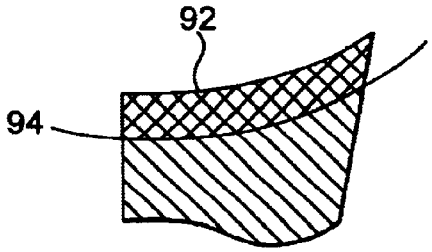
Figure 12D:
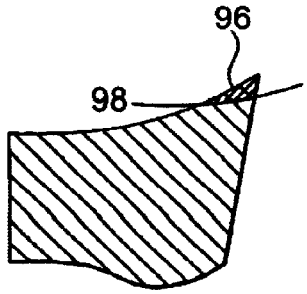

FIG. 11 illustrates this method. The diagram shows a normal section through the pressure angle relief surface of a blade as per plane $P_{prof}$ in FIG. 7(*b*). The equivalent curvature radii $R_{e1}$ and $R_{e2}$ for primary 78 and secondary 80 surfaces is similar to $R_e$ in 10(*a*) and 10(*b*), but the curvature centers for primary and secondary surfaces are different. Neither primary nor secondary segments of the side relief profile extend beyond the clearance envelope 72 defined by the nominal relief angle. Furthermore, due to the relatively short primary surface width $L_p$, the cutting edge relief angle very closely approximates the desired nominal relief angle, i.e. $\beta_{act} \approx \beta_{nom}$. Cutting performance problems that may otherwise occur due to side clearance and/or cutting edge relief angle errors are thus eliminated.

The method of FIG. 11 applies equally well to other relief surfaces on the blade, such as the tip and shoulder. In the case of the blade tip, for example, FIG. 11 would be taken with respect to the normal section $P_{tip}$ in FIG. 7(*a*), and top angles $\lambda_{nom}$ and $\lambda_{act}$ would replace relief angles $\beta_{nom}$ and $\beta_{act}$. The method thus enables the grinding process to satisfy the cutting edge relief angle and clearance requirements along the entire blade profile, including tip, profile and shoulder sections.

As noted earlier, restricting finish grinding to one edge on the grinding wheel results in lower wear of that particular edge and therefore increases the time interval between dressing operations. The dressing frequency benefit is enhanced even further, however, when the primary and secondary relief surface strategy is optionally applied to the inventive method. Provided the secondary surface is ground first, the volume of material removed during finishing of the primary land becomes even smaller than in the single relief surface case. The reduced finishing stock volume reduces the wear on the finishing edge, consequently allowing less frequent dressing.

FIGS. 12(*a*)–12(*d*) illustrate the difference in finish stock volume between single relief surface and primary/secondary relief surface cases. In FIG. 12(*a*), the stock removed during the roughing operation is shown as cross-hatched region 82 in a normal section through the relief surface of a blade (according to planes $P_{tip}$, $P_{prof}$, or $P_{sh}$ in FIG. 7). The stock volume represented by region 82 would typically represent about 80% of the total stock volume to be removed during a resharpening operation. This volume is preferentially removed during one rough grinding pass, but could be removed with more than one pass. Curved line 84 represents the periphery of the roughing edge of the grinding wheel during the last roughing operation. A final pass would then be taken on the blade to finish the entire relief surface from cutting edge to back. This is depicted in FIG. 12(*b*), where cross-hatched region 86 represents the remaining material to be removed with the finishing edge of the wheel, shown as curved line 88. The material volume corresponding to region 86 typically comprises about 20% of the total stock.

FIGS. 12(*c*) and 12(*d*) illustrate in analogous fashion how the roughing and finishing edges of the grinding wheel, when used to grind secondary and primary relief surfaces on the blade, respectively, lead to substantially reduced finishing stock volume. In FIG. 12(*c*), the stock removed during the secondary surface roughing operation is shown as cross-hatched region 92. The stock volume indicated by region 92 would typically represent about 95% to 98% of the total stock volume to be removed during a resharpening operation. This volume is preferentially removed during one rough grinding pass, but is not constrained to one pass. Curved line 94 represents the periphery of the roughing edge of the grinding wheel during the last roughing operation. The finishing pass indicated in FIG. 12(*d*), is designed to remove material along a small fraction of the total relief surface width, starting at the cutting edge. Cross-hatched region 96 represents the remaining material to be removed with the finishing edge of the wheel, shown as curved line 98. The volumetric removal required to produce the primary land is typically about 2% to 5% of the total stock amount—substantially less than in the former case.

When arranged to form primary and secondary relief surfaces, the inventive method with first and second grinding wheel edges brings further advantages, similar to those disclosed in U.S. Pat. No. 5,305,558 to Pedersen et al. Namely, the reduced finishing stock volume, as explained above with FIGS. 12(*a*)–(*d*) leads to reduced grinding forces during the finish grind. Hence, profile errors that may otherwise occur due to large and/or varying grinding force, are essentially eliminated, and the built-up edge or burr at the cutting edge becomes substantially smaller.

When used in conjunction with a grinding wheel having first and second grinding edges, the method of forming cutting blades with primary and secondary relief surfaces enables among other things (1) cutting blades produced with this method to have geometrically correct relief angle at the cutting edge while at the same time providing adequate side clearance extending to the back of the blade, (2) even longer wheel dress interval due to reduction in material removed during primary surface finishing, (3) elimination of profile errors due to grinding forces, and (4) smaller built up edge or burr at the cutting edge.

While the invention has been described with reference to preferred embodiments it is to be understood that the invention is not limited to the particulars thereof. The present invention is intended to include modifications which would be apparent to those skilled in the art to which the subject matter pertains without deviating from the spirit and scope of the appended claims.

What is claimed is:

1. A method of grinding a plurality of surfaces on a cutting blade, said method comprising:

positioning a cutting blade on a grinding machine, said grinding machine including a grinding wheel wherein said grinding wheel is cylindrically shaped and comprises a peripheral abrasive grinding portion having a first side, a second side and an outermost surface, a first grinding edge being defined by the intersection of said first side and a outermost surface, said second grinding edge being defined by the intersection of said second side and said outermost surface, rough grinding one or more of said surfaces, finish grinding one or more of said surfaces, wherein said rough grinding is carried out with said first grinding edge and said finish grinding is carried out with said second grinding edge.

2. The method of claim 1 wherein said plurality of surfaces comprises a cutting profile surface and a clearance profile surface.

3. The method of claim 1 wherein said plurality of surfaces comprises a cutting profile surface, a clearance profile surface and a front surface.

4. The method of claim 1 wherein said grinding wheel is moved in a feed direction along a surface during grinding and wherein said grinding wheel is oriented at an inclination angle relative to said feed direction during said moving along the surface, whereby a surface having a concave form is produced on the cutting blade.

5. The method of claim 1 wherein a primary relief surface and a secondary relief surface are formed on at least one surface of said cutting blade, said primary relief surface extending from a cutting edge to a location inward of the cutting edge and said secondary relief surface extending from the inward location to a back surface of the cutting blade.

6. The method of claim 5 wherein said primary relief surface and said secondary relief surface are formed on at least one of a cutting profile surface and a front surface.

7. The method of claim 5 wherein said secondary relief surface is formed with the rough grinding edge of the grinding wheel and the primary relief surface is formed with the finish grinding edge of the grinding wheel.

8. The method of claim 7 wherein said rough grinding edge removes 95–98% of the predetermined stock volume to be removed from said at least one surface and said finish grinding edge removes 2–5% of the predetermined stock volume to be removed from said at least one surface.

9. The method of claim 5 wherein said grinding wheel is moved in a feed direction along a surface during rough grinding and during finish grinding, wherein said grinding wheel is oriented at an inclination angle relative to said feed direction during said rough grinding and during said finish grinding with said inclination angles being different, whereby said primary relief surface and said secondary relief surface have equivalent curvature radii with different curvature centers.

10. A method of grinding cutting blades comprising:

providing a cylindrical-shaped grinding wheel having an axis of rotation and including abrasive material located radially outward from said axis, said abrasive material defining a peripheral portion of said grinding wheel, the abrasive peripheral portion comprising opposed first and second sides and an outermost surface, wherein said first side and said outermost surface intersect to define a first grinding edge and said second side and said outermost surface intersect to define a second grinding edge, positioning said grinding wheel on a cutting blade grinding machine, positioning a cutting blade on said grinding machine, said cutting blade having one or more surfaces to be ground, rough grinding at least one of said one or more surfaces with one of said first grinding edge and said second grinding edge, finish grinding at least one of said one or more surfaces with the other of said first grinding edge or said second grinding edge.

11. The method of claim 10 wherein said one or more surfaces comprises a cutting profile surface and a clearance profile surface.

12. The method of claim 10 wherein said one or more surfaces comprises a cutting profile surface, a clearance profile surface and a front surface.

13. The method of claim 10 wherein a primary relief surface and a secondary relief surface are formed on at east one surface of said cutting blade, said primary relief surface extending from a cutting edge to a location inward of the cutting edge and said secondary relief surface extending from the inward location to a back surface of the cutting blade.

14. The method of claim 13 wherein said secondary relief surface is formed with the rough grinding edge of the grinding wheel and the primary relief surface is formed with the finish grinding edge of the grinding wheel.

* * * * *